US008340554B2

(12) United States Patent
Morimoto et al.

(10) Patent No.: US 8,340,554 B2
(45) Date of Patent: Dec. 25, 2012

(54) DEVELOPING DEVICE AND IMAGE FORMING APPARATUS USING THE SAME

(75) Inventors: Kiyofumi Morimoto, Osaka (JP); Kohichi Takenouchi, Osaka (JP)

(73) Assignee: Sharp Kabushiki Kaisha, Osaka-Shi, Osaka ( * ) Notice: Subject to any disclaimer, the term of this patent is extended or adjusted under 35 U.S.C. 154(b) by 307 days.

(21) Appl. No.: 12/778,261

(22) Filed: May 12, 2010

(65) Prior Publication Data

US 2010/0290814 A1 Nov. 18, 2010

(30) Foreign Application Priority Data

May 12, 2009 (JP) ..... 2009-115817

(51) Int. Cl.
*G03G 15/08* (2006.01)

(52) U.S. Cl. ..... 399/256

(58) Field of Classification Search ..... 399/254–256
See application file for complete search history.

(56) References Cited

U.S. PATENT DOCUMENTS

| | | | | |
|---|---|---|---|---|
| 7,311,438 | B2 * | 12/2007 | Kim et al. | 366/295 |
| 2008/0145106 | A1 * | 6/2008 | Lee et al. | 399/256 |

FOREIGN PATENT DOCUMENTS

| | | | |
|---|---|---|---|
| JP | 10-063081 | A | 3/1998 |
| JP | 11-202626 | A | 7/1999 |
| JP | 2004-258237 | A | 9/2004 |
| JP | 2004-279979 | A | 10/2004 |

* cited by examiner

*Primary Examiner* — David Gray
*Assistant Examiner* — Gregory H Curran
(74) *Attorney, Agent, or Firm* — Nixon & Vanderhye P.C.

(57) ABSTRACT

A developing device includes a developing vessel, first and second conveying passages for conveying a developer, first and second conveying members for agitating and conveying the developer, a developing roller, a toner supply port for receiving a supply of toner and an agitator arranged under the toner supply port. The first conveying member has a rotary shaft and first and second conveying blades formed on the periphery of the rotary shaft. The agitator is arranged coaxially with the first conveying member so as to be rotatable independently from the first conveying member. The agitator includes a circular helical blade formed around the outer periphery of the second helical blade.

16 Claims, 8 Drawing Sheets

DEVELOPING DEVICE AND IMAGE FORMING APPARATUS USING THE SAME

This Nonprovisional application claims priority under 35 U.S.C. §119 (a) on Patent Application No. 2009-115817 filed in Japan on 12 May 2009, the entire contents of which are hereby incorporated by reference.

BACKGROUND OF THE INVENTION (1) Field of the Invention

The present invention relates to a developing device and an image forming apparatus using the device, in particular relating to a developing device using a dual-component developer containing a toner and a magnetic carrier, for use in an image forming apparatus for forming images using the toner based on electrophotography, such as an electrostatic copier, laser printer, facsimile machine or the like, as well as to an image forming apparatus using this device.

(2) Description of the Prior Art

Conventionally, image forming apparatuses based on electrophotography such as copiers, printers, facsimile machines and the like have been known. The image forming apparatus using electrophotography forms an image by forming an electrostatic latent image on a photoreceptor drum (toner image bearer) surface, supplying toner to the photoreceptor drum by a developing device to develop the electrostatic latent image, transferring the toner image formed on photoreceptor drum by development to a sheet of paper or the like, and fixing the toner image onto the sheet by means of a fixing device.

Recently, in the image forming apparatuses that support full-color reproduction and high-quality images, a dual-component developer (which will be referred to hereinbelow as simply "developer"), which can present excellent charge performance stability, is often used.

This developer consists of a toner and a carrier, which are agitated in the developing device and frictionally rubbed with each other so as to produce appropriately electrified toner.

In the developing device, the electrified toner is supplied to a developer supporting member, e.g., the surface of a developing roller. The toner thus supplied to this developing roller is moved by electrostatic attraction to the electrostatic latent image formed on the photoreceptor drum. Hereby, a toner image based on the electrostatic latent image is formed on the photoreceptor drum.

Further, the image forming apparatus is demanded to be made compact and operate at high speed, and it is also necessary to electrify the developer quickly and sufficiently and also convey the developer quickly and smoothly.

For this purpose, in order to disperse supplied toner promptly into the developer and provide the toner with an appropriate amount of charge, a circulating type developing device is adopted in the image forming apparatus.

The circulating type developing device includes a developer conveying passage as the path in which the developer is circulatively conveyed and a developer conveying member that agitates and conveys the developer in the developer conveying passage. The developer is electrified quickly and sufficiently while it is being agitated and conveyed in the developer conveying passage by the developer conveying member (see patent document 1: Japanese Patent Application Laid-open H10-63081).

In this circulating type developing device, a toner hopper is provided on the top of the developing device, so that toner will be added from the toner hopper to the developer conveying passage when the toner concentration in the developer inside the developer device becomes lower than a predetermined level. The toner added (which will be referred to hereinbelow as "added toner") is mixed with the previously existing developer and, electrified whilst it is being conveyed in the developer conveying passage.

In the developing device of this circulating type, however, there occurs a case where the added toner is supplied to the developing roller before the added toner is sufficiently mixed with the carrier (the previously existing developer), or in a low electrified state where the added toner has not yet been charged sufficiently.

When the toner that has not been charged sufficiently is supplied, the problem of the toner scattering from the developing roller is prone to occur, soiling the interior of the image forming apparatus and formed images. Additionally, if the toner that has not been sufficiently electrified is supplied to the developer, the electrostatic force for retaining the toner on the carrier surface is low so that there also occurs the problem that the toner tends to adhere to the non-image area and cause image fogging.

In order to deal with this problem, patent document 1 discloses a configuration where meshy screen members which the developer passes plural times are arranged in the developer conveying passage. In one example, the developer conveying member is configured of a screw that has helical feed blades around a rotary shaft while the screen members are disposed between blades.

However, even with the above developing device having screen members, a large amount of toner is added from the toner hopper to the developer conveying passage, and the toner is conveyed in a lumpy condition to the developer's top surface (developer surface) and cannot be sufficiently mixed with the carrier, thus causing the problem that insufficiently electrified toner is supplied to the developing roller.

Also, a method for enhancing the capability of mixing the added toner and the developer by making the blades of the developer conveying member larger may be considered, but this causes the problem that excessive stress is applied on the developer so that the developer is worn away quickly, shortening the life of the developer.

SUMMARY OF THE INVENTION

The present invention has been devised in view of the above conventional problems, it is therefore an object of the present invention to provide a developing device that can restrain insufficiently electrified toner from being supplied to the developing roller without causing excessive stress on the developer as well as to provide an image forming apparatus using this device.

The developing device for solving the above problems and the image forming apparatus using this are configured as follows:

The developing device according to the first aspect of the present invention includes: a developer receptacle for storing a developer containing a toner and a magnetic carrier; first and second developer conveying passages formed by sectioning the interior of the developer receptacle by a partitioning wall so as to communicate with each other at both the ends of the partitioning wall; first and second conveying members provided inside the first and second, conveying passages, respectively, for agitating and circulatively conveying the developer in the first conveying passage and the developer inside the second conveying passage, in the opposite directions to each other; a developing roller which supports the developer in the second developer conveying passage and supplies the toner contained in the developer to a photoreceptor drum; a toner supply port disposed in the first conveying passage to receive added toner; and an agitator disposed in the first conveying passage under the toner supply port, and is characterized in that the first conveying member includes: a rotary shaft; and a helical blade provided on the outer periphery of the rotary shaft, the agitator is formed coaxially with the first conveying member so as to be rotatable independently from the first conveying member, and the agitator includes a circular helix formed around the outer periphery of the helical blade of the first conveying member.

According to the developing device of the second aspect of the present invention, the circular helix is constructed so as to have the same pitch as that of the helical blade of the first conveying member, and the helical blade is arranged on the inner side of the inside diameter of the circular helix. That is, it is preferred that the circular helix is configured so as to inscribe the outer periphery of the helical blade.

According to the developing device of the third aspect of the present invention, it is preferred that the agitator rotates together with the helical blade of the first conveying member integrally in the same direction when toner is not supplied.

According to the developing device of the fourth aspect of the present invention, the agitator rotates in the opposite direction relative to the rotational direction of the first conveying member when toner is supplied. That is, it is preferable that the circular helix is controlled to rotate in the opposite direction relative to the rotational direction of the first conveying member or to be stopped.

The developing device of the fifth aspect of the present invention resides in an image forming apparatus for forming images with toner based on electrophotography, comprising: a photoreceptor drum for forming an electrostatic latent image on the surface thereof; a charging device for electrifying the surface of the photoreceptor drum; an exposure device for forming the electrostatic latent image on the photoreceptor drum surface; a developing device for forming a toner image by supplying toner to the electrostatic latent image on the photoreceptor drum surface; a transfer device for transferring the toner image on the photoreceptor drum surface to a recording medium; and, a fixing device for fixing the transferred toner image to the recording medium, and is characterized in that the developing device employs the developing device having any one of the above first to fourth features.

According to the developing device of the first aspect of the present invention, since mixing and agitation performance of the added toner and the developer can be improved with a space-saving configuration, it is possible to prevent insufficiently charged toner from being fed to the developing roller.

Further, since the agitator that is arranged coaxially with the first conveying member and that can rotate independently from the first conveying member is provided, when mixing and agitation of the developer is not needed so much, for example, when little amount of toner is added, or in other cases, the agitator can be rotated integrally in the same direction and at the same speed as the first conveying member so as to improve conveyance of the developer. On the other hand, when it is desirable to enhance agitation and mixture performance of the added toner and the existing developer, for example, when a large amount of toner is added, it is possible to enhance mixing and agitation performance of the developer by stopping or reducing the speed of the agitator or rotating in reverse relative to the first conveying member, it is hence possible to reduce unnecessary stress acting on the developer.

According to the developing device of the second aspect of the present invention, since the developer can be conveyed at the same speed by the agitator and the first conveying member, it is possible to reduce the stress acting on the developer during conveyance.

According to the developing device of the third aspect of the present invention, the circular helix of the agitator and the helical blade of the first conveying member integrally form a continuous helical blade structure so that irregular flow becomes unlikely to occur during conveyance of the developer, whereby it is possible to reduce stress on the developer.

According to the developing device of the fourth aspect of the present invention, since shearing force arising between the circular helix of the agitator and the helical blade of the first conveying member and acting on the developer is increased, it is possible to improve agitation and mixing performance of the developer. Also, since it is possible to inhibit loose lumps of added toner from being conveyed as floating over the top surface of the developer (developer surface) by means of the agitator, it is possible to efficiently prevent insufficiently charged toner from being fed to the developing roller.

According to the image forming apparatus of the fifth aspect of the present invention, since mixing and agitation performance of the added toner and the developer can be improved, it is possible to prevent insufficiently charged toner from being fed to the developing roller. Further, it is possible for the aforementioned developing device to reduce stress acting on the developer, it is hence possible to make the life of the developer longer and produce images free from fogging and decrease in image density over a long period of time.

DESCRIPTION OF THE PREFERRED EMBODIMENTS

Now, the embodied mode for carrying out the present invention will be described with reference to the drawings.

Figure 1:
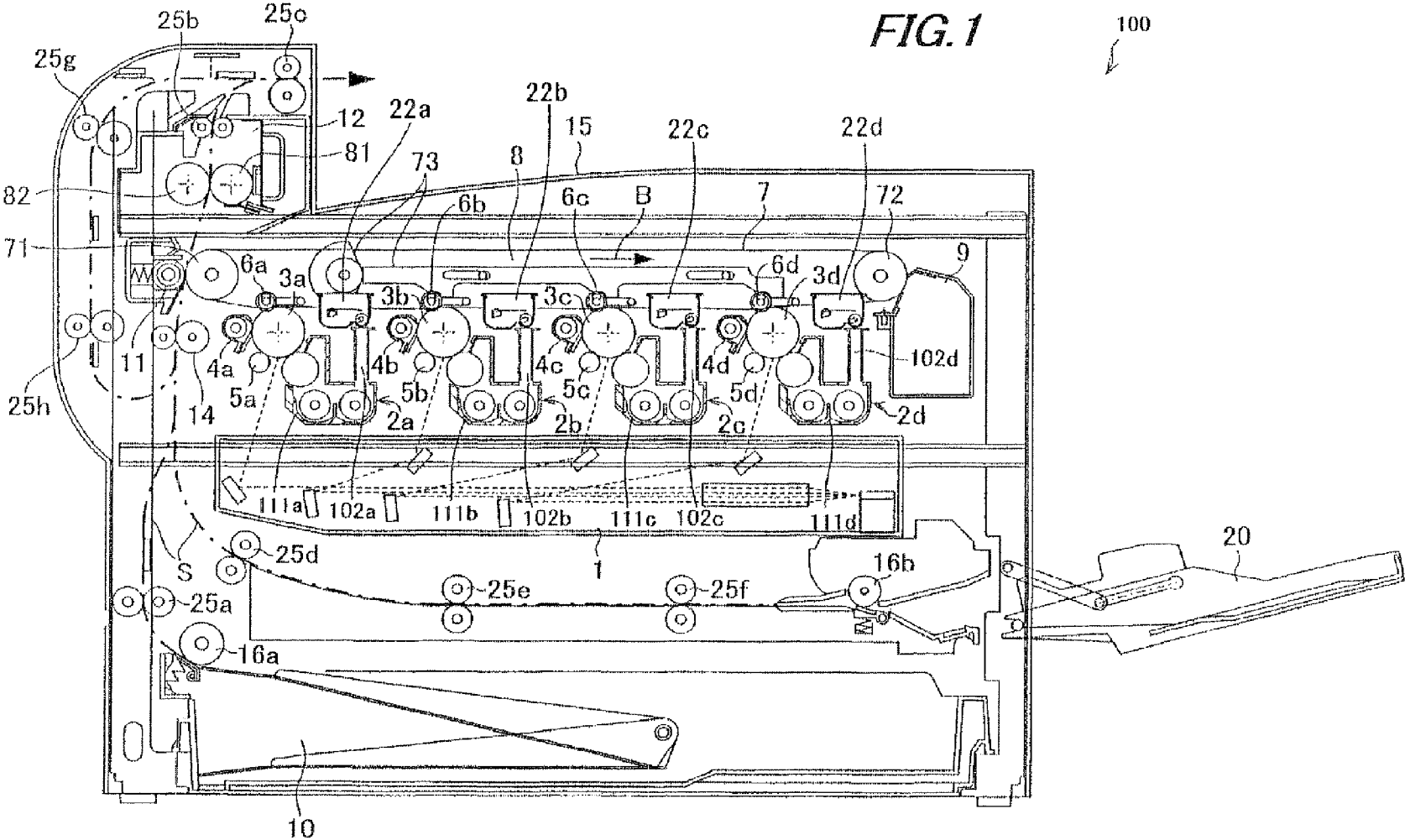
FIG. 1 is an illustrative view showing the overall configuration of an image forming apparatus in which a developing device according to the embodiment of the present invention is used.

FIG. 1 shows one exemplary embodiment of the present invention, and is an illustrative view showing the overall configuration of an image forming apparatus including a developing device according to the embodiment of the present invention.

An image forming apparatus 100 of the present embodiment forms an image with toners based on electrophotography, including: as shown in FIG. 1, photoreceptor drums 3*a*, 3*b*, 3*c* and 3*d* (which may be also called "photoreceptor drums 3" when general mention is made) for forming electrostatic latent images on the surface thereof; chargers (charging devices) 5*a*, 5*b*, 5*c* and 5*d* (which may be also called "chargers 5" when general mention is made) for charging the surfaces of photoreceptor drums 3; an exposure unit (exposure device) 1 for forming electrostatic latent images on the photoreceptor drum 3 surfaces; developing devices 2*a*, 2*b*, 2*c* and 2*d* (which may be also called "developing devices 2" when general mention is made) for supplying toners to the electrostatic latent images on the photoreceptor drum 3 surfaces to form toner images; toner supply devices 22*a*, 22*b*, 22*c* and 22*d* (which may be also called "toner supply devices 22" when general mention is made) for supplying toners to developing devices 2; an intermediate transfer belt unit (transfer device) 8 for transferring the toner images from the photoreceptor drum 3 surfaces to a recording medium; and a fixing unit (fixing device) 12 for fixing the toner image to the recording medium.

This image forming apparatus 100 forms a multi-color or monochrome image on a predetermined sheet (recording paper, recording medium) in accordance with image data externally transmitted. Here, image forming apparatus 100 may also include a scanner or the like on the top thereof.

To being with, the overall configuration of image forming apparatus 100 will be described.

As shown in FIG. 1, image forming apparatus 100 separately handles image data of individual color components, i.e., black (K), cyan (C), magenta (M) and yellow (Y), and forms black, cyan, magenta and yellow images, superimpose these images of different color components to produce a full-color image.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4 (4*a*, 4*b*, 4*c* and 4*d*) to form images of four different colors. In other words, four image forming stations (image forming portions) each including one developing device 2, one photoreceptor drum 3, one charger 5 and one cleaner unit 4 are provided.

Here, the symbols a to d are used, so that 'a' represents the components for forming black images, 'b' the components for forming cyan images, 'c' the components for forming magenta images and 'd' the components for forming yellow images. Image forming apparatus 100 also includes exposure unit 1, fixing unit 12, a sheet conveyor system S and a paper feed tray 10 and a paper output tray 15.

Charger 5 electrifies the photoreceptor drum 3 surface at a predetermined potential.

As charger 5, other than the contact roller-type charger shown in FIG. 1, a contact brush-type charger, a non-contact type discharging type charger and others may be used.

Exposure unit 1 is a laser scanning unit (LSU) including a laser emitter and reflection mirrors as shown in FIG. 1. Other than the laser scanning unit, arrays of light emitting elements such as EL (electroluminescence) and LED writing 1 illuminates the photoreceptor drums 3 that have been electrified, in accordance with input image data so as to form electrostatic latent images corresponding to the image data on the surfaces of photoreceptor drums 3.

Developing device 2 (2*a*, 2*b*, 2*c* or 2*d*) visualizes (develops) the electrostatic latent image formed on photoreceptor drum 3 with toner of K, C, M or Y. Arranged over developing devices 2 are toner transport mechanisms 102*a*, 102*b*, 102*c* and 102*d* (which may also be called "toner transport mechanisms 102" when general mention is made), toner supply devices 22 (22*a*, 22*b*, 22*c* and 22*d*) and developing vessels (developer receptacle) 111*a*, 111*b*, 111*c* and 111*d* (which may also be called "developer vessels 111" when general mention is made).

Toner supply device 22 is arranged on the upper side of developing vessel 111 and stores unused toner (powder toner). This unused toner in toner supply device 22 is supplied to developing vessel 111 by means of toner transport mechanism 102.

Cleaner unit 4 removes and collects the toner remaining on the photoreceptor drum 3 surface after development and image transfer steps.

Arranged over photoreceptor drums 3 are an intermediate transfer belt unit 8. Intermediate transfer belt unit 8 includes intermediate transfer rollers 6*a*, 6*b*, 6*c* and 6*d* (which may also be called "intermediate transfer rollers 6" when general mention is made), an intermediate transfer belt 7, an intermediate transfer belt drive roller 71, an intermediate transfer belt driven roller 72, an intermediate transfer belt tensioning mechanism 73 and an intermediate transfer belt cleaning unit 9.

Intermediate transfer rollers 6, intermediate transfer belt drive roller 71, intermediate transfer belt driven roller 72 and intermediate transfer belt tensioning mechanism 73 support and tension intermediate transfer belt 7 to circulatively drive intermediate transfer belt 7 in the direction of an arrow B in FIG. 1.

Intermediate transfer rollers 6 are rotatably supported at intermediate transfer roller fitting portions in intermediate transfer belt tensioning mechanism 73. Applied to each intermediate transfer roller 6 is a transfer bias for transferring the toner image from photoreceptor drum 3 to intermediate transfer belt 7.

Intermediate transfer belt 7 is arranged so as to be in contact with each photoreceptor drum 3. The toner images of different color components formed on photoreceptor drums 3 are successively transferred one over another to intermediate transfer belt 7 so as to form a full-color toner image (multi-color toner image). This intermediate transfer belt 7 is formed of an endless film of about 100 μm to 150 μm thick, for instance.

Transfer of the toner image from photoreceptor drum 3 to intermediate transfer belt 7 is effected by intermediate transfer roller 6 which is in contact with the interior side of intermediate transfer belt 7. A high-voltage transfer bias (a high voltage of a polarity (+) opposite to the polarity (−) of the electrostatic charge on the toner) is applied to each intermediate transfer roller 6 in order to transfer the toner image.

Intermediate transfer roller 6 is composed of a shaft formed of metal (e.g., stainless steel) having a diameter of 8 to 10 mm and a conductive elastic material (e.g., EPDM, foamed urethane, etc.) coated on the shaft surface. Use of this conductive elastic material enables intermediate transfer roller 6 to uniformly apply high voltage to intermediate transfer belt 7. Though in the present embodiment, roller-shaped elements (intermediate transfer rollers 6) are used as the transfer electrodes, brushes etc. can also be used in their place.

The electrostatic latent image formed on each of photoreceptor drums 3 is developed as described above with the toner associated with its color component into a visual toner image. These toner images are laminated on intermediate transfer belt 7, laying one image over another. The thus formed lamination of toner images is moved by rotation of intermediate transfer belt 7 to the contact position (transfer position) between the conveyed paper and intermediate transfer belt 7, and is transferred to the paper by a transfer roller 11 arranged at that position. In this case, intermediate transfer belt 7 and transfer roller 11 are pressed against each other forming a predetermined nip while a voltage for transferring the toner image to the paper is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 72 is formed of a hard material such as metal or the like while the other is formed of a soft material such as an elastic roller or the like (elastic rubber roller, foamed resin roller etc.).

Of the toner adhering to intermediate transfer belt 7 as the belt comes in contact with photoreceptor drums 3, the toner which has not been transferred from intermediate transfer belt 7 to the paper during transfer of the toner image and remains on intermediate transfer belt 7 would cause contamination of color toners at the next operation, hence is removed and collected by an intermediate transfer belt cleaning unit 9.

Intermediate transfer belt cleaning unit 9 includes a cleaning blade (cleaning member) that is put in contact with intermediate transfer belt 7. Intermediate transfer belt 7 is supported from its interior side by intermediate transfer belt driven roller 72, at the area where this cleaning blade is put in contact with intermediate transfer belt 7.

Paper feed tray 10 is to stack sheets (e.g., recording paper) to be used for image forming and is disposed under the image forming portion and exposure unit 1. On the other hand, paper output tray 15 disposed at the top of image forming apparatus 100 stacks printed sheets with the printed face down.

Image forming apparatus 100 also includes sheet conveyor system S for guiding sheets from paper feed tray 10 and from a manual feed tray 20 to paper output tray 15 by way of the transfer portion and fixing unit 12. Here, the transfer portion is located between intermediate transfer belt drive roller 71 and, transfer roller 11.

Arranged along sheet conveyor system S are pickup rollers 16 (16*a*, 16*b*), a registration roller 14, the transfer portion, fixing unit 12 and feed rollers 25 (25*a* to 25*h*) and the like.

Feed rollers 25 are a plurality of small-diametric rollers arranged along sheet conveyor system S to promote and assist sheet conveyance. Pickup roller 16*a* is a roller disposed at the side of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 temporarily suspends the sheet being conveyed on sheet conveyor system S and delivers the sheet to the transfer portion at such timing that the front end of the sheet meets the front end of the image area on intermediate transfer belt 7.

Fixing unit 12 includes a heat roller 81, a pressing roller 82 and the like. These heat roller 81 and pressing roller 82 rotate while nipping the sheet therebetween. Heat roller 81, is controlled by a controller (not shown) so as to keep a predetermined fixing temperature. This controller controls the temperature of heat roller 81 based on the detection signal from a temperature detector (not shown).

Heat roller 81 fuses, mixes and presses the lamination of color toner images transferred on the sheet by thermally pressing the sheet with pressing roller 82 so as to thermally fix the toner onto the sheet. The sheet with a multi-color toner image (a single color toner image) fixed thereon is conveyed by plural feed rollers 25 to the inversion paper discharge path of sheet conveyor system S and discharged onto paper output tray 15 in an inverted position (with the multi-color toner image placed facedown).

Next, the operation of sheet conveyance by sheet conveyor system S will be described.

As shown in FIG. 1, image forming apparatus 100 has paper feed tray 10 that stacks sheets beforehand and manual feed tray 20 that is used when a few pages are printed out. Each tray is provided with pickup roller 16 (16*a*, 16*b*) so that these pickup rollers 16 supply the paper one sheet at a time to sheet conveyor system S.

In the case of one-sided printing, the sheet conveyed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the image area including the lamination of toner images on intermediate transfer belt 7. At the transfer portion, the toner image is transferred onto the sheet. Then, this toner image is fixed onto the sheet by fixing unit 12. Thereafter, the sheet passes through feed roller 25*b* to be discharged by paper output roller 25*c* onto paper output tray 15.

Also, the sheet conveyed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet which has been printed on the first side and passed through fixing unit 12 as described above is nipped at its rear end by paper discharge roller 25*c*. Then the paper discharge roller 25*c* is rotated in reverse so that the sheet is guided to feed rollers 25*g* and 25*h*, and conveyed again through registration roller 14 so that the sheet is printed on its rear side and then discharged to paper output tray 15.

Next, the configuration of toner supply device 22 of the present embodiment will be specifically described.

Figure 2:
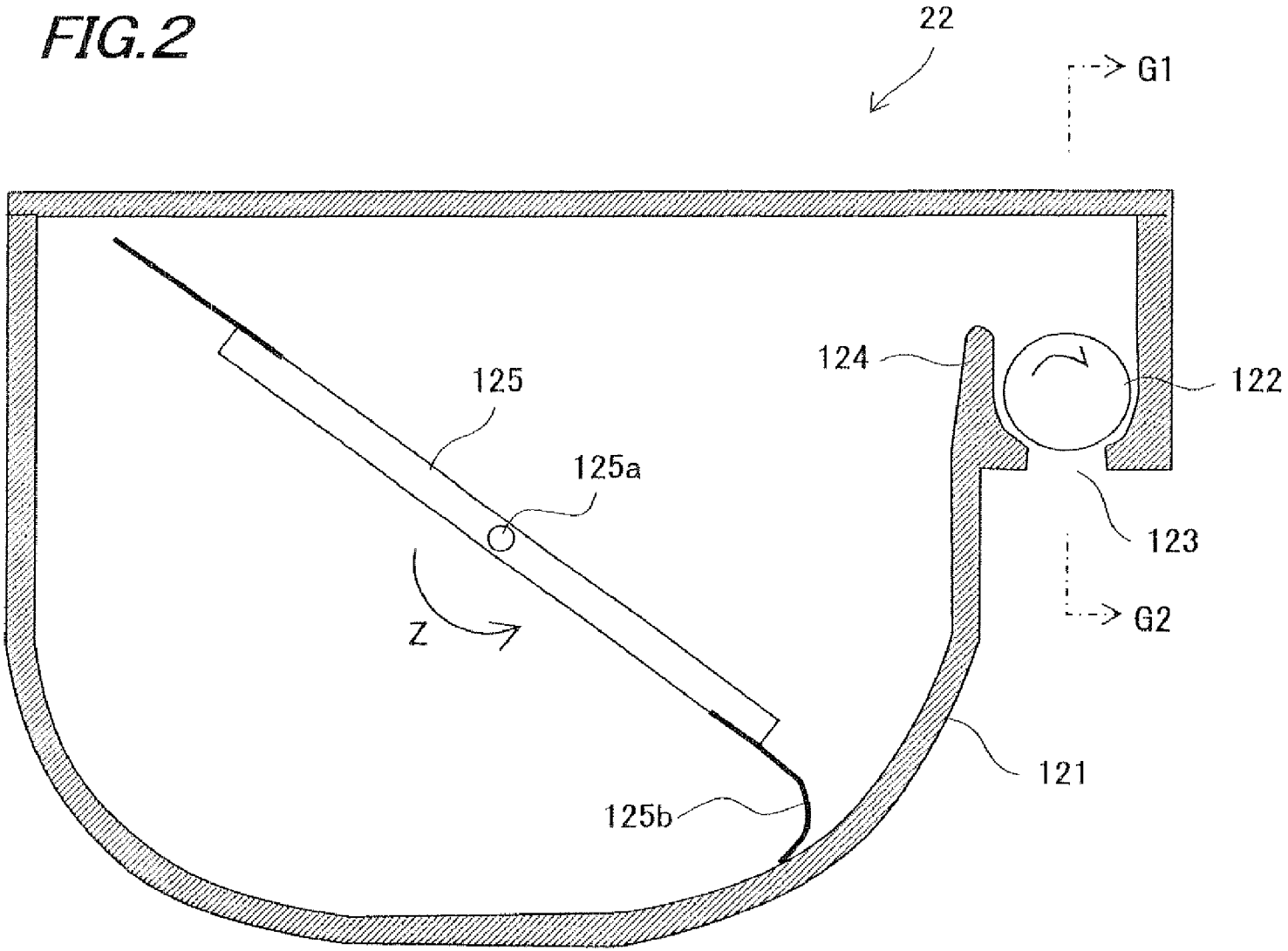
FIG. 2 is a sectional view showing the schematic configuration of a toner supply device that constitutes the image forming apparatus.
Figure 3:
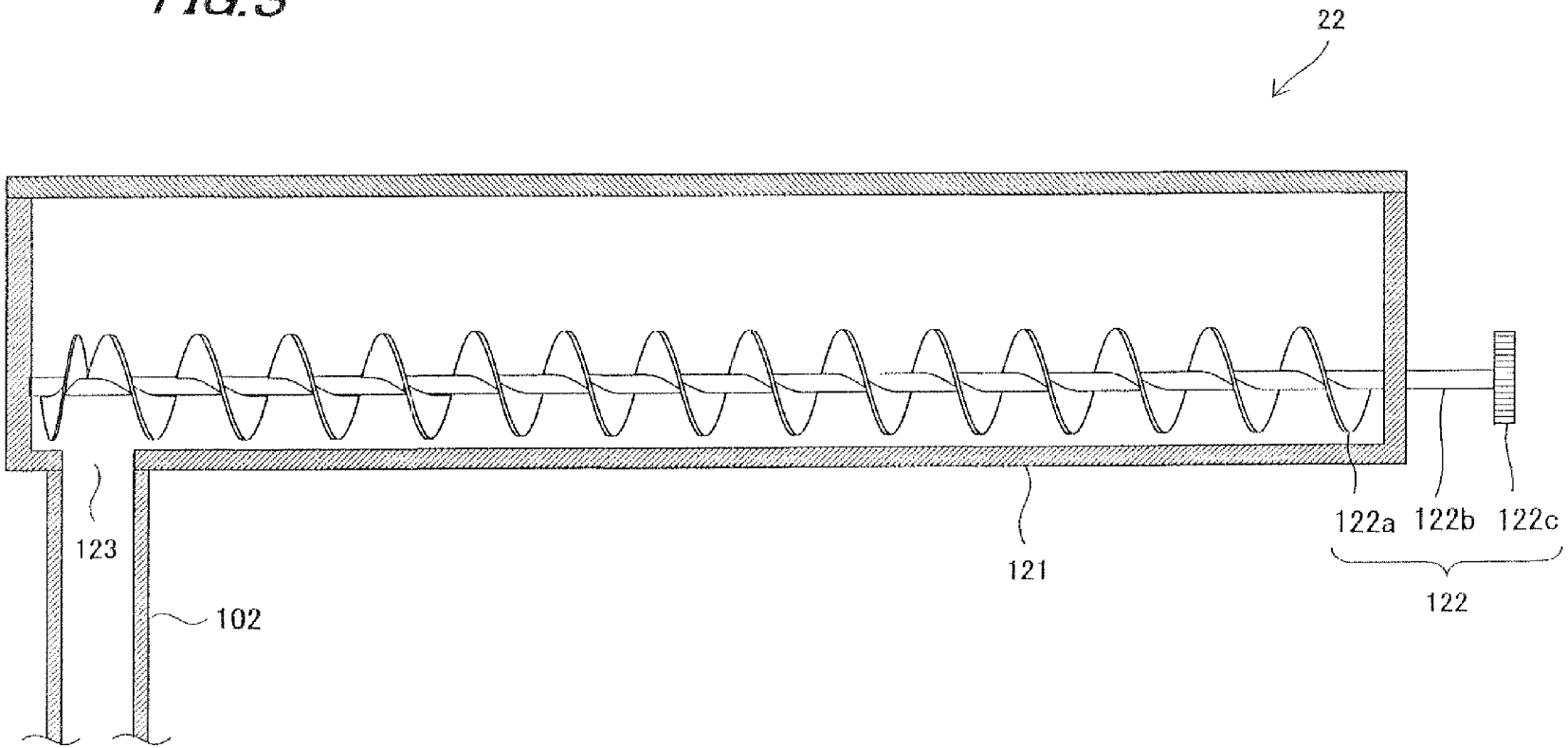
FIG. 3 is a sectional view cut along a plane G1-G2 in FIG. 2.

FIG. 2 is a sectional view showing the schematic configuration of the toner supply device that constitutes the image forming apparatus according to the present embodiment. FIG. 3 is a sectional view cut along a plane G1-G2 in FIG. 2.

As shown in FIGS. 2 and 3, toner supply device 22 includes a toner storing container 121, a toner agitator 125, a toner discharger 122 and a toner discharge port 123. Toner supply device 22 is arranged on the upper side of developing vessel 111 and stores unused toner (powder toner). The toner in toner supply device 22 is supplied from toner discharge port 123 to developing vessel 111 (FIG. 1) by means of toner transport mechanism 102 (FIG. 1) as toner discharger (discharging screw) 122 is rotated.

Toner storing container 121 is a container part having a substantially semicylindrical configuration with a hollow interior, rotationally supporting toner agitator 125 and toner discharger 122 to store toner. As shown in FIG. 3, toner discharge port 123 is a substantially rectangular opening disposed under toner discharger 122 and positioned so as to oppose toner transport mechanism 102.

Toner agitator 125 is a plate-like part that rotates about a rotary axis 125*a* in the direction of arrow Z as shown in FIG. 2 and draws up and conveys the toner stored inside toner storing container 121 toward toner discharger 122 whilst agitating the toner stored inside toner storing container 121. Toner agitator 125 has a toner scooping part 125*b* at either end and extended along rotary axis 125*a*. Toner scooping part 125*b* is formed of a polyethylene terephthalate (PET) sheet having flexibility and is attached to both ends parallel to rotary axis 125*a* of toner agitator 125.

Toner discharger 122 dispenses the toner in toner storing container 121 from toner discharge port 123 to developing vessel 111, and is formed of an auger screw of a toner conveyor blade 122*a* and a toner discharger rotary shaft 122*b* and a toner discharger rotating gear 122*c*, as shown in FIG. 3. Toner discharger 122 is rotationally driven by an unillustrated toner discharger drive motor. As to the helix direction of the auger screw, toner conveyor blade 122*a* is designed so that toner can be conveyed from both ends of toner discharger 122 toward toner discharge port 123 with respect to the axial direction of toner discharger rotational shaft 122*b*.

Provided between toner discharger 122 and toner agitator 125 is a toner discharger partitioning wall 124. This wall makes it possible to keep and hold the toner scooped by toner agitator 125 in an appropriate amount around toner discharger 122.

As shown in FIG. 2, when toner agitator 125 agitates and scoops up the toner toward toner agitator 122 by its rotation in the direction of arrow Z, toner scooping parts 125*b* rotate as they are deforming and sliding over the interior wall of toner storing container 121 due to the flexibility thereof, to thereby supply the toner toward the toner discharger 122 side. Then, toner discharger 122 turns so as to lead the supplied toner to toner discharge port 123.

Next, developing device 2 will be described with reference to the drawings.

Figure 4:
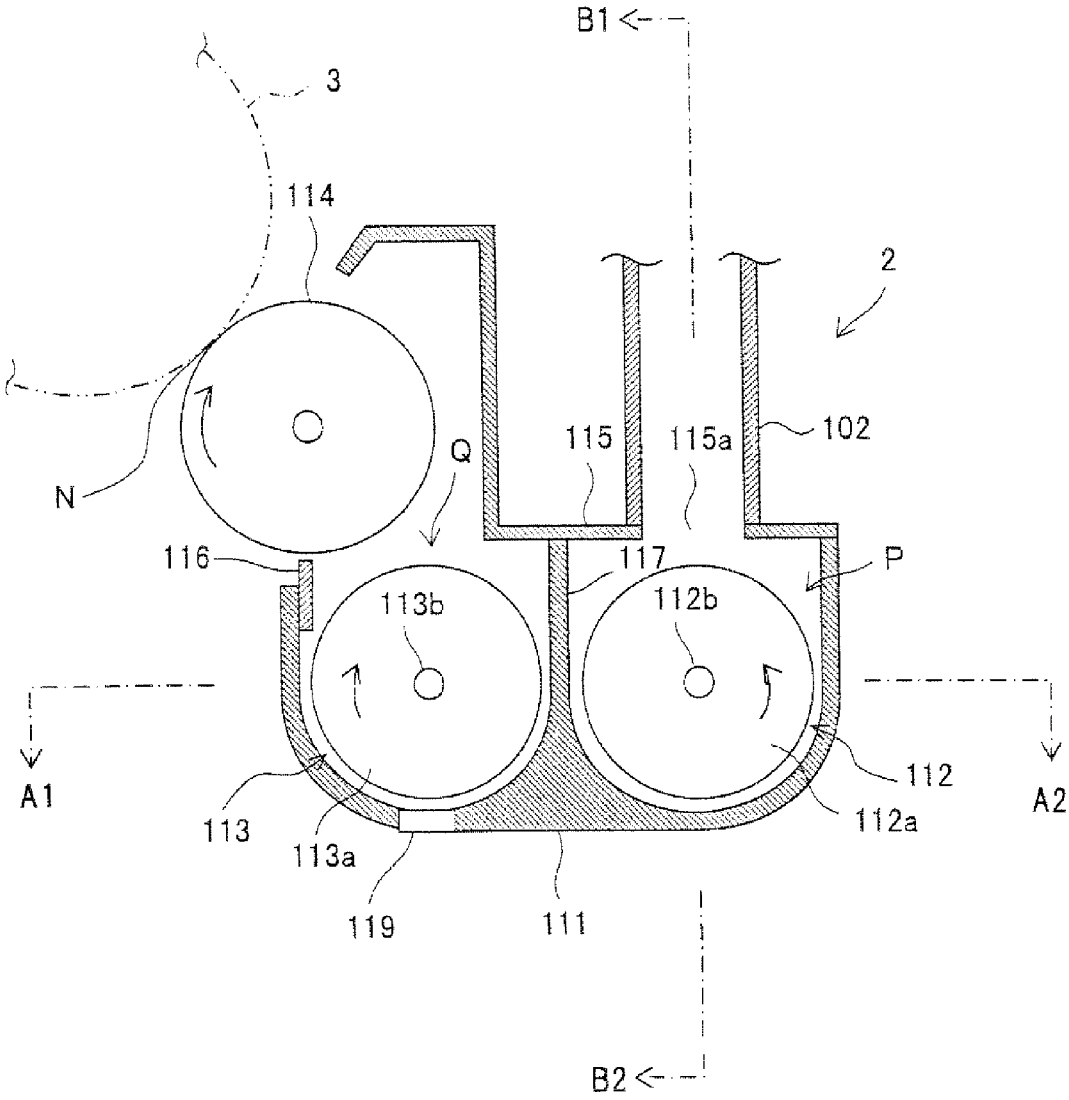
FIG. 4 is a sectional view showing the configuration of a developing device that constitutes the image forming apparatus.
Figure 5:
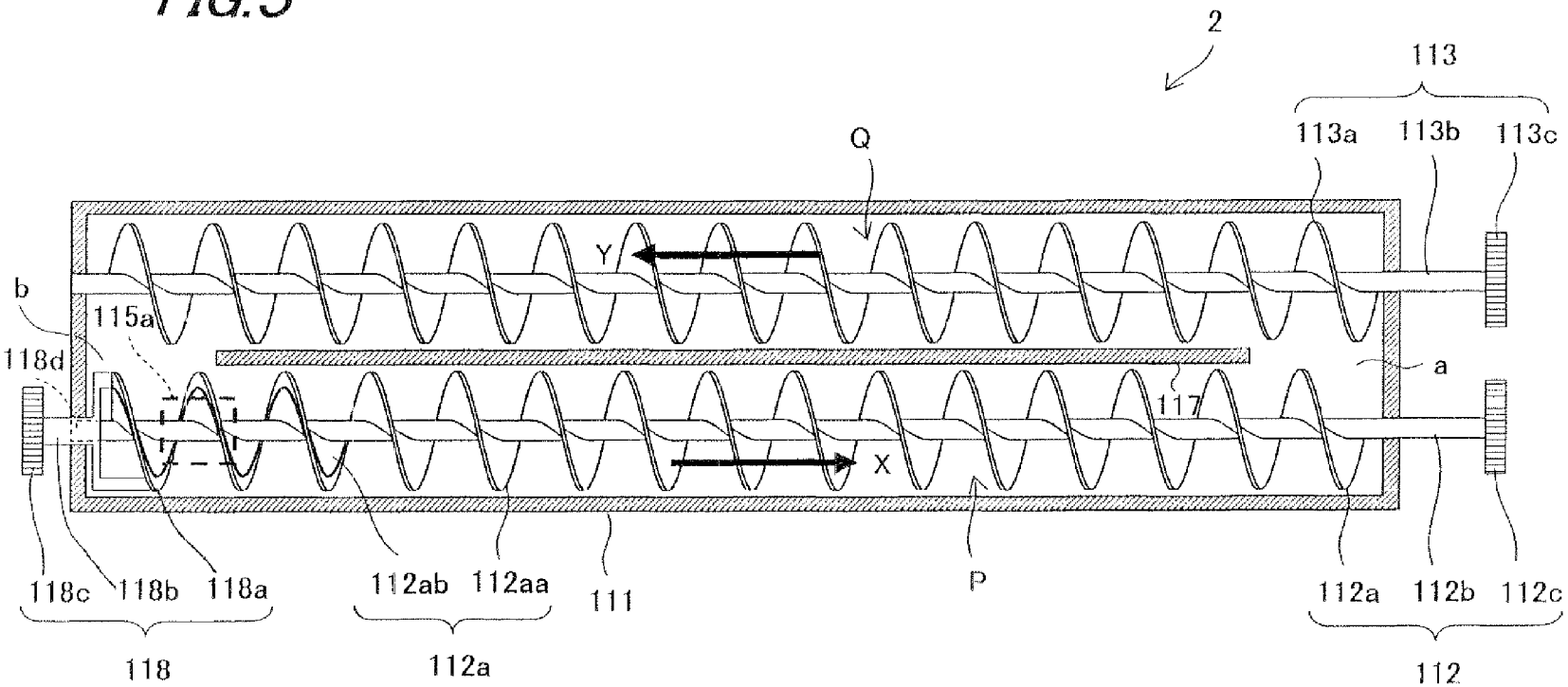
FIG. 5 is a sectional view cut along a plane A1-A2 in FIG. 4.

FIG. 4 is a sectional view showing the configuration of developing device 2, and FIG. 5 is a sectional view cut along a plane A1-A2 in FIG. 4.

As shown in FIG. 4, developing device 2 has a developing roller 114 arranged inside developing vessel 111 so as to oppose photoreceptor drum 3 and supplies toner from developing roller 114 to the photoreceptor drum 3 surface to visualize (develop) the electrostatic latent image formed on the surface of photoreceptor drum 3.

As shown in FIGS. 4 and 5, developing device 2, other than developing roller 114, further includes developing vessel 111, a developing vessel cover 115, a toner supply port 115*a*, a doctor blade 116, a first conveying member 112, a second conveying member 113, a partitioning plate (partitioning wall) 117, a toner concentration detecting sensor 119 and an agitator 118.

Developing vessel 111 is a receptacle for holding a developer that contains a toner and a carrier. Developing vessel 111 includes developing roller 114, first conveying member 112, second conveying member 113, agitator 118 and the like. Here, the carrier in the present embodiment is a magnetic carrier presenting magnetism.

Arranged in developing vessel 111 is partitioning plate 117 between first conveying member 112 and second conveying member 113. Partitioning plate 117 is extended parallel to the axial direction (the direction in which each rotary axis is laid) of first and second conveying members 112 and 113. The interior of developing vessel 111 is divided by partitioning plate 117 into two sections, namely, a first conveying passage P with first conveying member 112 arranged therein and a second conveying passage Q with second conveying member 113 arranged therein.

Arranged on the top of developing vessel 111 is removable developing vessel cover 115, as shown in FIG. 4. This developing vessel cover 115 is formed with toner supply port 115*a* for receiving unused toner into developing vessel 111.

Partitioning plate 117 is arranged so that its ends, with, respect to the axial direction of first and second conveying members 112 and 113, are spaced from respective interior wall surfaces of developing vessel 111. Hereby, developing vessel 111 has communicating paths that communicate between first conveying passage P and second conveying passage Q at around both axial ends of first and second conveying members 112 and 113.

In the following description, as shown in FIG. 5, the communicating path formed on the downstream side with respect to the direction of arrow X is named first communicating path a and the communicating path formed on the downstream side with respect to the direction of arrow Y is named second communicating path b.

First conveying member 112 and second conveying member 113 are arranged so that their axes are parallel to each other with their peripheral sides opposing each other across partitioning plate 117, and rotated in opposite directions. That is, first conveying member 112 conveys the developer in the direction of arrow X while second conveying member 113 conveys the developer in the direction of arrow Y, which is the opposite to the direction of arrow X, as shown in FIG. 5.

Developing roller 114 is a rotating magnet roller which is rotationally driven about its axis by an unillustrated means, draws up and carries the developer in developing vessel 111 on the surface thereof and supplies toner contained in the developer supported on the surface thereof to photoreceptor drum 3. This developing roller 114 is arranged parallel to, and away from, photoreceptor drum 3, so as to oppose photoreceptor drum 3, as shown in FIG. 4.

The developer conveyed by developing roller 114 comes in contact with photoreceptor drum 3 in the area where the roller surface and the drum surface become closest. This contact area forms a developing nip portion N. As a developing bias is applied to developing roller 114 from an unillustrated power source that is connected to developing roller 114, the toner included in the dual-component developer on the developing roller 114 surface is supplied at developing nip portion N to the electrostatic latent image on the photoreceptor drum 3 surface.

Arranged at a position close to the surface of developing roller 114 is a doctor blade (layer thickness regulating blade) 116.

Doctor blade 116 is a rectangular plate-shaped member that is disposed parallel to the direction in which the axis of developing roller 114 is extended (axial direction). Doctor blade 116 is supported vertically below developing roller 114 along its one longitudinal side by developing vessel 111 while the opposite longitudinal edge is positioned a predetermined gap away from the developing roller 114 surface. This doctor blade 116 may be made of stainless steel, or may be formed of aluminum, synthetic resin or the like.

Toner concentration detecting sensor 119 is attached on the bottom of developing vessel 111, at a position vertically under second conveying member 113 with its sensor surface exposed to the interior of developing vessel 111. Toner concentration detecting sensor 119 is electrically connected to an unillustrated toner concentration controller. This toner concentration controller controls the associated components in accordance with the measurement of toner concentration detected by toner concentration detecting sensor 119 so as to supply toner from toner discharge port 123 into developing vessel 111 by rotationally driving toner discharger 122.

When the toner concentration controller determines that the measurement of toner concentration from toner concentration detecting sensor 119 is lower than the set toner concentration level, the controller sends a control signal to the driver for rotationally driving toner discharger 122, so as to rotationally drive toner discharger 122. Toner concentration detecting sensor 119 may use typical toner detecting sensors. Examples include transmitted light detecting sensors, reflected light detecting sensors, magnetic permeability detecting sensors, etc. Of these, magnetic permeability detecting sensors are preferable.

The magnetic permeability detecting sensor is connected to an unillustrated power supply. This power supply applies the drive voltage for driving the magnetic permeability detecting sensor and the control voltage for outputting the detected result of toner concentration to the controller to the magnetic permeability detecting sensor. Application of voltage to magnetic permeability detecting sensor from the power supply is controlled by the controller. The magnetic permeability detecting sensor is a sensor that receives application of a control voltage and outputs the detected result of toner concentration as an output voltage. Since, basically, the sensor is sensitive in the middle range of the output voltage, the applied control voltage is adjusted so as to produce an output voltage around that range. Magnetic permeability detecting sensors of this kind are found on the market, examples including TS-L, TS-A, TS-K (all of these are trade names of products of TDK Corporation), etc.

Further, as shown in FIG. 1, the toner store in toner supply device 22 is transported into developing vessel 111 through toner transport mechanism 102 and toner supply port 115*a*, and thereby supplied to developing vessel 111.

As shown in FIG. 5, first conveying member 112 is composed of an auger screw formed of a helical first conveying blade (helical blade) 112*a* and a first rotary shaft 112*b*, and a first conveying gear 112*c*. As shown in FIG. 5, second conveying member 113 is composed of an auger screw formed of a helical second conveying blade (helical blade) 113*a* and a second rotary shaft 113*b*, and a second conveying gear 113*c*. First conveying member 112 and second conveying member 113 are rotationally driven by drive means (not shown) such as a motor etc., to agitate and convey the developer in the first conveying passage P and the second conveying passage Q, respectively.

More specifically, in first conveying passage P, the developer is agitated and conveyed in the direction of arrow X by first conveying member 112 to reach first communicating path a. The developer reaching first communicating path a is conveyed through first communicating path a to second conveying passage Q.

On the other hand, in second conveying passage Q, the developer is agitated and conveyed in the direction of arrow Y by second conveying member 113 to reach second communicating path b. Then, the developer reaching second communicating path b is conveyed through second communicating path b to first conveying passage P.

That is, first conveying member 112 and second conveying member 113 agitate the developer while conveying the developer in opposite directions.

In this way, the developer is circulatively moving in developing vessel 111 along first conveying passage 2, first communicating path a, second conveying passage Q and second communicating path b, in this mentioning order. In this arrangement, the developer is carried and drawn up by the surface of rotating developing roller 114 while being conveyed in second conveying passage Q, and the toner in the drawn up developer is continuously consumed as moving toward photoreceptor drum 3.

In order to compensate for this consumption of toner, unused toner is supplied from toner supply port 115*a* into first conveying passage P. The supplied toner is agitated and mixed with the previously existing developer in the first conveying passage P.

Next, first conveying member 112 and agitator 118 will be described in detail with reference to the drawings.

Figure 6:
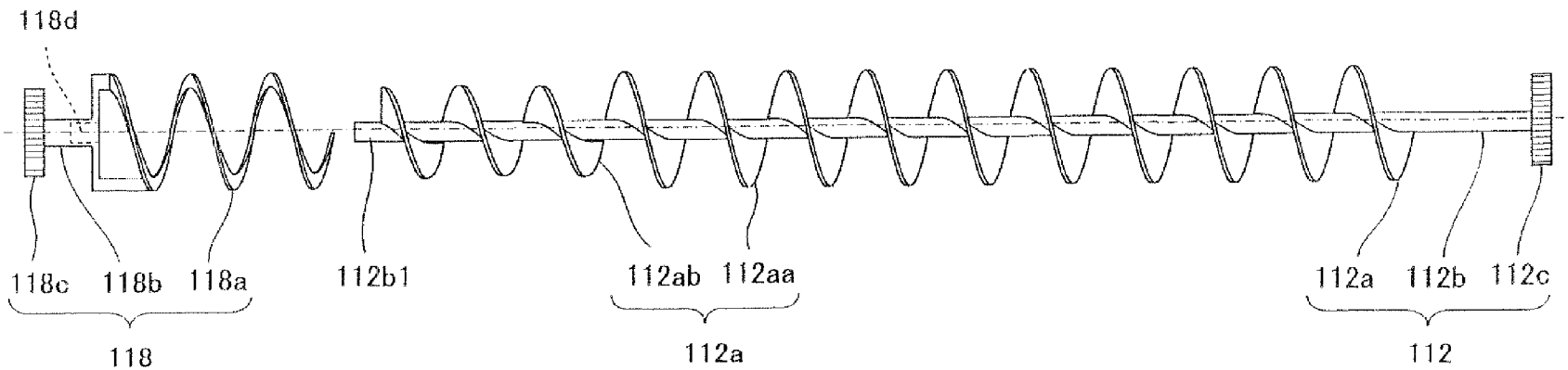
FIG. 6 is an illustrative view showing a configuration of an agitator that constitutes the developing device.

FIG. 6 shows a state before first conveying member 112 and agitator 118 are assembled, showing the individual configurations of first conveying member 112 and agitator 118.

Figure 7:
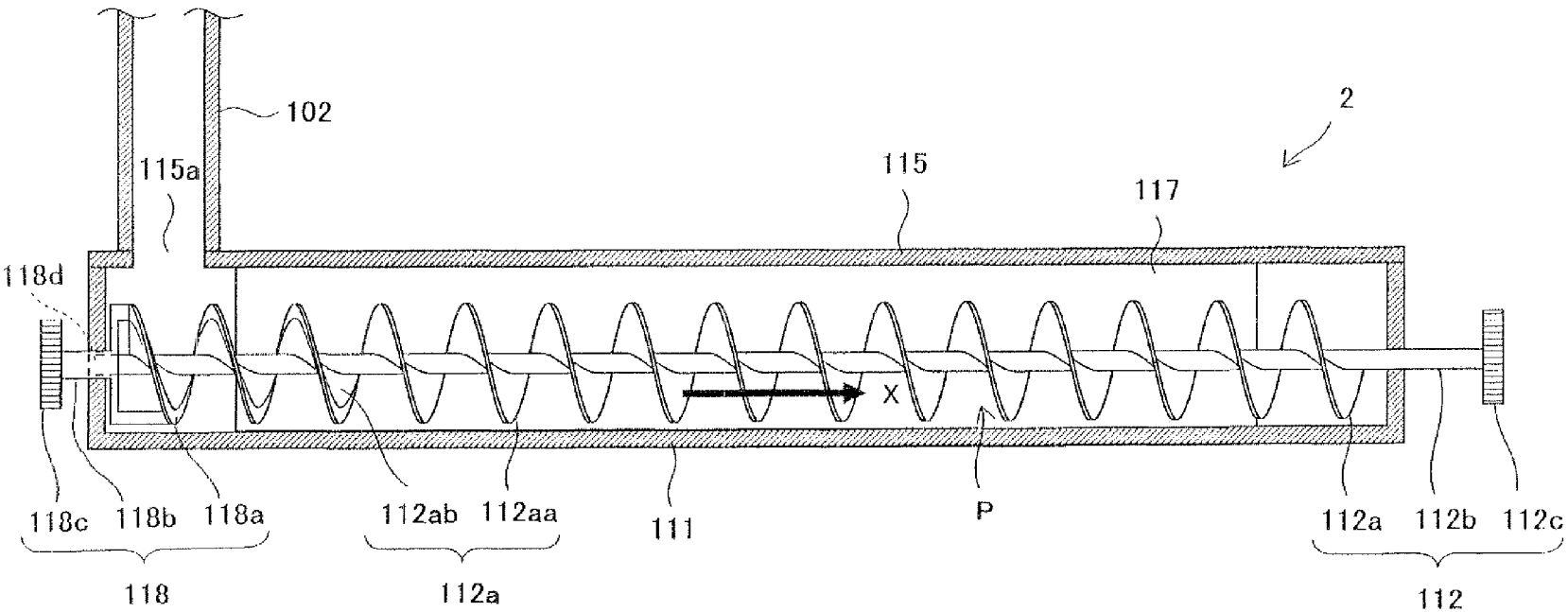
FIG. 7 is a sectional view cut along a plane B1-B2 in FIG. 4; and, FIG. 8 is an illustrative view showing a state where there is a difference in rotational speed between the agitator and a helical blade of a first conveying member, causing a phase difference therebetween.

FIG. 7 is a sectional view cut along a plane B1-B2 in FIG. 4, showing a state after first conveying member 112 and agitator 118 have been assembled. FIG. 7 shows a state where agitator 118 and a helical blade 112*ab* of first conveying member 112 are integrally rotating at the same rotational rate.

Figure 8:
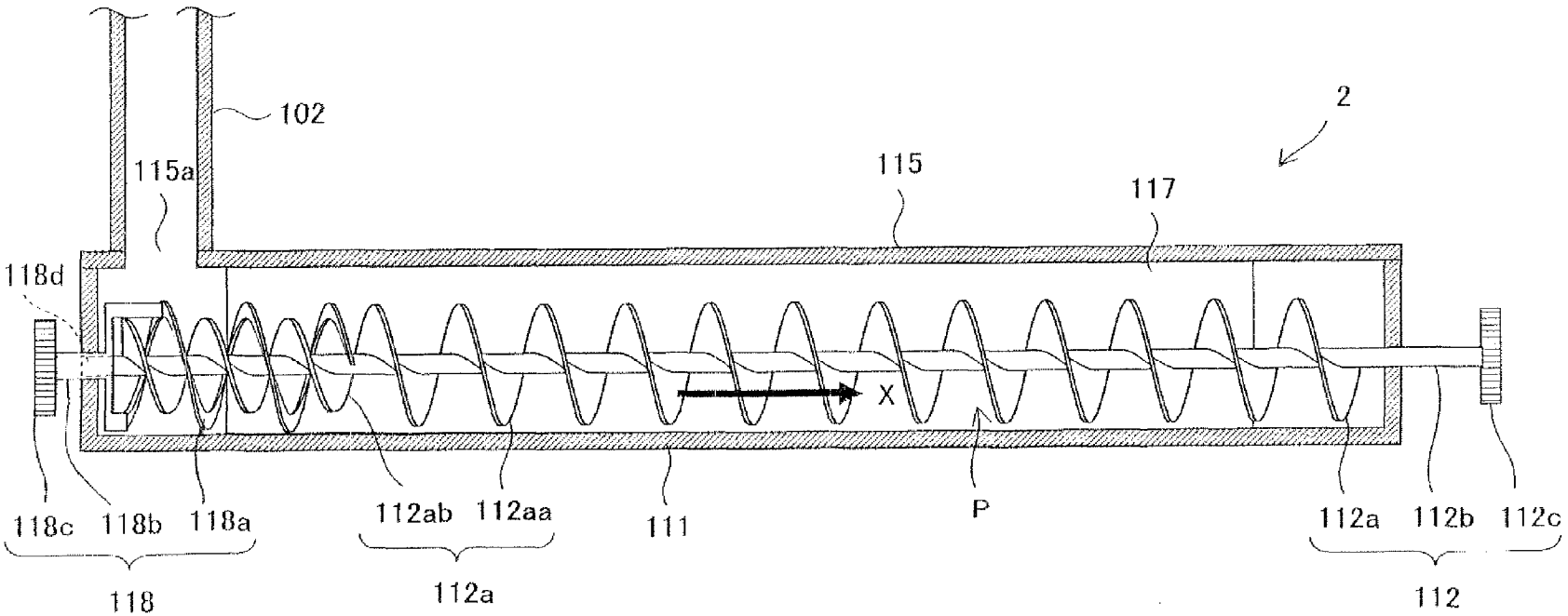

FIG. 8 shows a state where the first agitator 118 and helical blade 112*ab* of first conveying member 112 rotate at different rotational rates, hence presenting phase difference between the rotation of agitator 118 and the rotation of helical blade 112*ab*.

As shown in FIG. 5, first conveying member 112 is composed of an auger screw formed of a helical first conveying blade (helical blade) 112*a* and a first rotary shaft 112*b*, and a first conveying gear 112*c*. First conveying member 112 is rotationally driven by a drive means (not shown) such as a motor etc., to agitate and convey the developer.

As shown in FIGS. 5 and 6, first conveying blade 112*a* is formed, of a first helical blade 112*aa* and a second helical blade 112*ab*, provided on the outer periphery of first rotary shaft 112*b*.

Second conveying blade 112*ab* is formed on the same axis as first helical blade 112*aa*, having the same helical pitch as, and a smaller diameter than, first helical blade 112*aa*. In the present embodiment, first helical blade 112*aa* and second helical blade 112*ab* are formed contiguously.

Second helical blade 112*ab* is constructed such as to be positioned under toner supply port 115*a* when first conveying member 112 has been mounted in developing vessel 111. The radius of second helical blade 112*ab* is formed to be 0.9 times of the radius of first inner helical blade 112*aa*.

As shown in FIGS. 5 and 6, agitator 118 includes a circular helix blade (circular helix) 118*a* that is formed along the outer periphery of second helical blade 112*ab*, an agitator rotary shaft 118*b* supporting circular helix blade 118*a* and agitator drive gear 118*c*, and is arranged so that circular helix blade (circular helix) 118*a* can rotate under toner supply port 115*a*. Further, agitator 118 is arranged coaxially with first conveying member 112 and rotationally driven in the same direction as the rotational direction of first conveying member 112 and driven independently from first conveying member 112.

A bearing part 118*d* (FIGS. 5 and 6) that rotatably supports one end 112*b*1 (FIG. 6) of first rotary shaft 112*b* is provided for, and coaxially with, agitator rotary shaft 118*b*, so as to cancel the difference in rotational rate between agitator rotary shaft 118*b* and first rotary shaft 112*b*.

Circular helix blade 118*a* is constructed such as to be positioned under toner supply port 115*a* when agitator 118 has been mounted in developing vessel 111.

Further, circular helix blade 118*a* is constructed so that the helical pitch thereof is the same as that of second helical blade 112*ab* of first conveying member 112 and that second helical blade 112*ab* is arranged inside the inside diameter of circular helix blade 118*a*. More specifically, circular helix blade 118*a* is configured so as to inscribe the outer periphery of second helical blade 112*ab* in the inner circle thereof. With this configuration, it is possible to arrange circular helix blade 118*a* and second helical blade 112*ab* integrally and continuously.

Further, the outside diameter of circular helix blade 118*a* is formed to be equal to the outside diameter of first helical blade 112*aa* of first conveying member 112.

In the present embodiment, as shown in FIG. 7 agitator 118 is normally controlled to rotate integrally with, and in the same direction at the same rotational rate as, second helical blade 112*ab* of first conveying member 112. On the other hand, when agitation and mixing performance of the added toner and the developer needs to be enhanced such as toner is added or the like, agitator 118 is controlled to rotate in the opposite direction relative to the rotating direction of first conveying member 112. That is, agitator 118 is controlled to rotate in the opposite direction relative to first conveying member 112 or to be stopped.

Next, agitation and conveyance of the developer inside developing vessel 111 by developing device 2 of the present invention will be described in detail with reference to the drawings.

In image forming apparatus 100 of the present embodiment, when no toner is supplied to developing device 2, circular helix blade 118*a* of agitator 118 and second helical blade 112*ab* of first conveying member 112 are positioned so as to form integrated and continuous geometry as shown in FIG. 7. First conveying member 112 and agitator 118 in this geometry are controlled to integrally rotate in the same direction at the same rotational rate.

As a result, in the first conveying passage F, circular helix blade 118*a* of agitator 118 and second helical blade 112*ab* of first conveying member 112 integrally form a continuous helical blade structure so that irregular flow becomes unlikely to occur during conveyance of the developer, whereby it is possible to reduce stress on the developer during conveyance of the developer.

On the other hand, when toner is added to developing device 2, it is necessary to enhance agitation and mixture performance of the added toner and the existing developer, so that agitator 118 is controlled to rotate in the opposite direction to the rotational direction of first conveying member 112. In the present embodiment, agitator 118 rotates in the direction opposite to the rotational direction of first conveying member 112.

As a result, in the first conveying passage P, circular helix blade 118*a* rotates in the opposite direction to the rotational direction of second helical blade 112*ab*, so that shearing force arising between circular helix blade 118*a* and second helical blade 112*ab* and acting on the developer is increased, whereby it is possible to improve agitation and mixing performance of the developer. Also, when second helical blade 112*ab* conveys the developer, loose lumps of toner can be inhibited from being conveyed as floating over the top surface of the developer (developer surface) by means of circular helix blade 118*a*. Accordingly, it is possible to efficiently prevent insufficiently charged toner from being fed to the developing roller.

According to the present invention thus constructed as above, in developing device 2 of image forming apparatus 100, agitator 118 that is disposed coaxially with, and that can rotate independently from, first conveying member 112, is provided under toner supply port 115*a* in the first conveying passage P, and circular helix blade 118*a* is provided around the periphery of second helical blade 112*ab* of first conveying member 112 as a part of the agitator 118. Accordingly, it is possible to improve mixing and agitation performance of the added toner and the developer with a space-saving configuration and efficiently prevent insufficiently charged toner from being fed to the developing roller.

That is, since, in the present embodiment, the toner that has been sufficiently agitated and hence electrified by developing device 2 can be supplied to the developing roller, it is possible in image forming apparatus 100 to provide preferable images free from image fogging and decrease in image density.

Further, according to the present embodiment, first conveying member 112 including first helical blade 112*aa* and second helical blade 112*ab* is constructed to form a helical blade geometry by integrating second helical blade 112*ab* with circular helix blade 118*a* of agitator 118 while the outside diameter of circular helix blade 118*a* is formed to have the same outside diameter of first helical blade 112*aa*. As a result, irregular flow becomes unlikely to occur during conveyance of the developer, so that it is possible to reduce stress on the developer.

Though the above embodiment was described taking an example in which developing device 2 of the present invention is applied to image forming apparatus 100 shown in FIG. 1, as long as it is an image forming apparatus using a developing device that includes first and second conveying passages within a developing vessel and conveys the developer whilst agitating by means of first and second conveying members, the invention can be developed to any other image forming apparatus and the like, not limited to the image forming apparatus and copier having the configuration described above.

Having described heretofore, the present invention is not limited to the above embodiment, various changes can be made within the scope of the appended claims. That is, any embodied mode obtained by combination, of technical means modified as appropriate without departing from the spirit and scope of the present invention should be included in the technical art of the present invention.

What is claimed is:

1. A developing device comprising:

a developer receptacle for storing a developer containing a toner and a magnetic carrier;

first and second developer conveying passages formed by sectioning the interior of the developer receptacle by a partitioning wall so as to communicate with each other at both the ends of the partitioning wall;

first and second conveying members provided inside the first and second conveying passages, respectively, for agitating and circulatively conveying the developer in the first conveying passage and the developer inside the second conveying passage, in the opposite directions to each other;

a developing roller which supports the developer in the second developer conveying passage and supplies the toner contained in the developer to a photoreceptor drum;

a toner supply port disposed in the first conveying passage to receive added toner; and an agitator disposed in the first conveying passage under the toner supply port, characterized in that the first conveying member includes:

a rotary shaft; and, a helical blade provided on the outer periphery of the rotary shaft, the agitator is formed coaxially with the first conveying member so as to be rotatable independently from the first conveying member, and the agitator includes a circular helix formed around the outer periphery of the helical blade of the first conveying member, and wherein the circular helix has the same pitch as that of the helical blade of the first conveying member and the helical blade is arranged on the inner side of the inside diameter of the circular helix.

2. The developing device according to claim 1, wherein the agitator rotates together with the helical blade of the first conveying member integrally in the same direction when toner is not supplied.

3. The developing device according to claim 1, wherein the agitator rotates in the opposite direction relative to the rotational direction of the first conveying member when toner is supplied.

4. The developing device according to claim 2, wherein the agitator rotates in the opposite direction relative to the rotational direction of the first conveying member when toner is supplied.

5. An image forming apparatus for forming images with toner based on electrophotography, comprising:

a photoreceptor drum for forming an electrostatic latent image on the surface thereof;

a charging device for electrifying the surface of the photoreceptor drum;

an exposure device for forming the electrostatic latent image on the photoreceptor drum surface;

a developing device for forming a toner image by supplying toner to the electrostatic latent image on the photoreceptor drum surface;

a transfer device for transferring the toner image on the photoreceptor drum surface to a recording medium; and, a fixing device for fixing the transferred toner image to the recording medium, characterized in that the developing device employs the developing device defined in claim 1.

6. The developing device according to claim 1, wherein the circular helix of the agitator comprises a narrow, flat blade having a helix shape.

7. The developing device according to claim 1, wherein the helical blade of the first conveying member includes a first portion having a first outside diameter and a second portion having a second outside diameter that is smaller than the first outside diameter.

8. The developing device according to claim 7, wherein the agitator is located around the outer periphery of the second portion of the helical blade of the first conveying member.

9. The developing device according to claim 8, wherein the circular helix of the agitator comprises a narrow, flat blade having a helix shape, and wherein an outside diameter of the circular helix is substantially the same as the outside diameter of the first portion of the helical blade of the first conveying member.

10. A developing device comprising:

a developer receptacle for storing a developer containing a toner and a magnetic carrier;

first and second developer conveying passages formed by sectioning the interior of the developer receptacle by a partitioning wall so as to communicate with each other at both the ends of the partitioning wall;

first and second conveying members provided inside the first and second conveying passages, respectively, for agitating and circulatively conveying the developer in the first conveying passage and the developer inside the second conveying passage, in the opposite directions to each other;

a developing roller which supports the developer in the second developer conveying passage and supplies the toner contained in the developer to a photoreceptor drum;

a toner supply port disposed in the first conveying passage to receive added toner; and an agitator disposed in the first conveying passage under the toner supply port, characterized in that the first conveying member includes:

a rotary shaft; and, a helical blade provided on the outer periphery of the rotary shaft, the agitator is formed coaxially with the first conveying member so as to be rotatable independently from the first conveying member, and the agitator includes a circular helix formed around the outer periphery of the helical blade of the first conveying member, and wherein the agitator rotates in the opposite direction relative to the rotational direction of the first conveying member when toner is supplied.

11. The developing device according to claim 10, wherein the agitator rotates together with the helical blade of the first conveying member integrally in the same direction when toner is not supplied.

12. The developing device according to claim 10, wherein the circular helix of the agitator comprises a narrow, flat blade having a helix shape.

13. The developing device according to claim 10, wherein the helical blade of the first conveying member includes a first portion having a first outside diameter and a second portion having a second outside diameter that is smaller than the first outside diameter.

14. The developing device according to claim 13, wherein the agitator is located around the outer periphery of the second portion of the helical blade of the first conveying member.

15. The developing device according to claim 14, wherein the circular helix of the agitator comprises a narrow, flat blade having a helix shape with the same pitch as that of the helical blade of the first conveying member, and wherein an outside diameter of the circular helix is substantially the same as the outside diameter of the first portion of the helical blade of the first conveying member.

16. The developing device according to claim 15, wherein an inside diameter of the circular helix of the agitator is substantially the same as the outside diameter of the second portion of the helical blade of the first conveying member.

* * * * *